US005897673A

United States Patent [19]

Nishida et al.

[11] Patent Number: 5,897,673

[45] Date of Patent: Apr. 27, 1999

[54] FINE METALLIC PARTICLES-CONTAINING FIBERS AND METHOD FOR PRODUCING THE SAME

[75] Inventors: Ryosuke Nishida, Okugun; Yoko Yamamoto, Okayama, both of Japan

[73] Assignee: Japan Exlan Company Limited, Japan

[21] Appl. No.: 08/761,700

[22] Filed: Dec. 6, 1996

[30] Foreign Application Priority Data

Dec. 29, 1995 [JP] Japan ..... 7-353255
Mar. 4, 1996 [JP] Japan ..... 8-075259

[51] Int. Cl.[6] ..... C09B 67/00; A61L 9/00; A61L 9/01; A61L 11/00

[52] U.S. Cl. ..... 8/624; 8/618; 8/539; 8/543; 8/115.51; 8/115.54; 8/491; 8/493; 514/493; 424/76.1; 424/76.2; 424/76.3; 424/76.4; 424/76.7

[58] Field of Search ..... 521/142, 64; 510/166; 526/341, 342; 399/127; 264/165, 206, 331.16; 424/76.2, 76.1, 76.3, 76.4, 76.7; 430/527, 558, 595, 49, 96, 87; 34/390; D23/364–366; 8/115.54, 115.51, 618, 539, 543, 493, 491, 624; 514/493

[56] References Cited

U.S. PATENT DOCUMENTS

| | | | |
|---|---|---|---|
| 4,149,870 | 4/1979 | Kozuki | 71/21 |
| 4,312,907 | 1/1982 | Hiraoka et al. | 428/212 |
| 4,670,223 | 6/1987 | Delachapelle | 422/122 |
| 5,013,636 | 5/1991 | Ohno et al. | 430/522 |
| 5,342,716 | 8/1994 | Kato et al. | 430/49 |
| 5,360,574 | 11/1994 | Iwahashi | 252/187.21 |
| 5,436,275 | 7/1995 | Kawasaki et al. | 521/142 |

FOREIGN PATENT DOCUMENTS

| | | |
|---|---|---|
| 0 426 862 | 5/1991 | European Pat. Off. . |
| 56-148965 | 11/1981 | Japan . |
| 63-309613 | 12/1988 | Japan . |

OTHER PUBLICATIONS

*Chemical Abstracts*, vol. 96, No. 10, Abstract No. 70396q (abstract of JP 81–148965) (Mar. 1982).

*Patent Abstracts of Japan*, vol. 005, No. 008 (C–039) (abstract of JP 55–137210) (Jan. 1981).

*Primary Examiner*—Lynette F. Smith
*Assistant Examiner*—Datquan Lee
*Attorney, Agent, or Firm*—Wenderoth, Lind & Ponack, L.L.P.

[57] ABSTRACT

Fine metallic particles-containing fibers with various fine metallic particles therein, which have fiber properties to such degree that they can be processed and worked, and which can exhibit various functions of the fine metallic particles, such as antibacterial deodorizing and electroconductive properties are provided, as well as a method for producing the same.

20 Claims, No Drawings

FINE METALLIC PARTICLES-CONTAINING FIBERS AND METHOD FOR PRODUCING THE SAME

BACKGROUND OF THE INVENTION

1. Technical Field of the Invention

The present invention relates to fine metallic particles-containing fibers and a method for producing the same. The incorporation of fine particles of metals and/or hardly-soluble metallic salts into fibers can make the fibers have various functions intrinsic to such fine metallic particles, such as antibacterial property, antifungal property, odor-repelling property, deodorizing property, flame-retarding property, ultraviolet-preventing property, heat-retaining property, surface-improving property, designed property, refreshing property, electroconductive property, rust-preventing property, lubricative property, magnetic property, light-reflecting property, selectively light-absorbing property, heat-absorbing property, heat-conductive property, and heat-reflecting property. Therefore, the fine metallic particles-containing fibers with such functions can be used in various fields.

2. Prior Art

Fibers with various functions have heretofore been proposed, which contain fine metallic particles having particle sizes of not larger than micron orders or so in fiber matrices. The most popular are fine metallic particles-containing fibers to be obtained by adding and dispersing fine metallic particles themselves in a polymer followed by making the resulting polymer fibrous, such as those disclosed in Japanese Patent Application Laid-Open Nos. 1-96244, 2-16940 and 6-293611. Also known are fine metallic particles-containing fibers to be obtained by making fine inorganic particles carry fine metallic particles thereon, adding the resulting fine inorganic particles to a resin, and shaping the resulting resin, such as those disclosed in Japanese Patent Application Laid-Open Nos. 7-165519 and 7-173392. However, in such conventional, fine metallic particles-containing fibers to be obtained according to the known methods, it is difficult to uniformly disperse the fine metallic particles or the inorganic particles in the polymer since the specific gravity of the metallic particles or the inorganic particles differs from that of the polymer, since the affinity of the particles for the polymer is poor. In addition, the methods are still problematic in that, of the fine metallic particles to be added in them, finer metallic particles of not larger than sub-micron orders are difficult to prepare, that the cost of such finer particles is high, and that it is difficult to safely handle such finer particles. For these reasons, therefore, the particle sizes of fine metallic particles capable of being actually used in industrial plants are limited. Moreover, there is still another problem with the known methods in that the fibers shall frequently experience a heat history in the shaping and processing steps, in which the metals themselves in the fibers are often deteriorated.

In Japanese Patent Application Laid-Open Nos. 6-287355 and 6-293611, disclosed are shaped articles such as fibers to be produced by incorporating a metallic salt or the like into a polymer matrix, then reducing the metallic salt through heat-treatment of the polymer to thereby give a resin containing ultra-fine particles as uniformly dispersed therein, and finally shaping the resin. However, this method is problematic in that (1) there is a probability that the metallic complex or metallic salt is not uniformly dispersed in the polymer matrix during the step of mixing them, (2) the cost of the metallic complex or metallic salt to be used is high, (3) the ligand of the metallic complex used or the compound having a counter ion to the metal ion of the metallic salt used becomes unnecessary after the conversion of the metallic complex or the metallic salt into fine metallic particles, and such unnecessary substances, as often dissolving out of the final product, have some negative influences on the basic physical properties and other properties of the final product, (4) since the final product shall contain a large amount of the ligand of the metallic complex used or the compound having a counter ion to the metal ion of the metallic salt used, which becomes unnecessary after the precipitation of fine metallic particles, it is impossible to increase the content of the fine metallic particles in the final product, and (5) since the matrix to be used in the conventional techniques as referred to hereinabove is a thermoplastic resin capable of being shaped and processed under heat, the final product to be obtained could not have high heat resistance.

In Japanese Patent Application Laid-Open No. 56-148965, disclosed are fine silver particles-containing fibers in which metal silver is in the surface layer of each fiber. However, this prior art technique disclosed is also problematic in that (1) since a carboxylic acid is localized in the smallest possible area in the surface layer of each fiber in order to prevent the physical properties of the fibers from being deteriorated, the amount of the polar group capable of carrying the metal is reduced with the result that the amount of the fine metallic particles to be in the fibers is limited, and (2) since fibers that are generally obtainable in ordinary industrial plants have a thickness of about 10$\mu$ or more and therefore have a small surface area relative to the unit weight, their efficiency of expressing the functions of the fine metallic particles contained therein is low, and in addition, the fine metallic particles existing in the inside of the fibers but not on their surfaces could not be utilized effectively. For these problematic reasons (1) and (2), if the functions of metals are desired to be effectively utilized or, for example, if a large amount of a metal is desired to be incorporated into fibers in order to make the fibers antifungal, the amount of the fine metallic particles-containing fibers themselves to be mixed with other fibers must be increased, resulting in the increase in the cost of the mixed fibers. Moreover, since the amount itself of the metal existing in the fibers is not satisfactorily large, the fibers could not often express the intended functions. In addition to these (1) and (2), the prior art technique disclosed is still further problematic in that (3) since the fine metallic particles are localized only in the surface area of each fiber, the fine metallic fibers are dropped off, when the fibers are mechanically abraded, for example, in the post-processing step, thereby resulting in significant reduction in the functions of the fibers, though such is not so much problematic if the post-processing step is conducted under relatively mild conditions, and (4) since the ion-exchanged silver ion is once precipitated in the form of a silver compound and thereafter the compound is reduced, the silver compound precipitated is often removed out of the system, resulting in the reduction in the utilization of the silver ions, and in addition, the two-step reaction is troublesome and expensive.

On the other hand, with the recent diversification in the life style and with the recent increase in the density of the living environment and also the recent increase in the airtight condition in the living environment, odors have become considered problematic in the living environment and the demand for removing odors from the living environment is increasing.

Some conventional deodorizing fibers are known, for example, activated charcoal-containing fibers, and also fibers with a deodorizing substance as adhered to and fixed on their surfaces or kneaded into the fibers by post-treatment, which, however, are all problematic. Precisely, since activated charcoal-containing fibers are black and, in addition, basically have low physical properties, their use is limited. The fibers with a deodorizing substance as adhered to and fixed on their surfaces by post-treatment could not basically have large deodorizing capacity. The fibers with a deodorizing substance as kneaded thereinto by post-treatment are problematic in that, if the particles of the deodorizing substance as kneaded into the fibers have large particle sizes, they greatly worsen the physical properties of the fibers. Therefore, in the deodorizing substance-kneaded fibers, the particles of the deodorizing substance are desired to have small particle sizes. In these, in addition, it is desired that the particles of the deodorizing substance have the smallest possible particle sizes also in view of the deodorizing capacity of the fibers. However, since the particles of the deodorizing substance to be kneaded into fibers are limited in reducing their particle sizes, the deodorizing substance-kneaded fibers are still problematic in that they could not sufficiently express the deodorizing effect of the substance.

Problems to be Solved by the Invention

One object of the present invention is to provide fine metallic particles-containing fibers which can be produced with ease at low costs and which are free from the problems in the prior art, such as those mentioned hereinabove, and also to provide a method for producing said fibers.

Another object of the present invention is to provide deodorizing fibers which exhibit excellent deodorizing capacity for nitrogen-containing compounds, such as ammonia, and also for sulfur-containing compounds, such as hydrogen sulfide, and which are free from the problems in the prior art, such as those mentioned hereinabove.

Means for Solving the Problems

We, the present inventors have assiduously studied fibers containing fine metallic fibers and methods for producing them. As a result, we have found that the above-mentioned objects can be attained by incorporating fine particles of metals and/or hardly-soluble metallic salts into crosslinked polymers having ion-exchangeable or ion-coordinable polar groups, and have completed the present invention. Accordingly, the present invention is to provide fine metallic particles-containing fibers that contain fine particles of metals and/or hardly-soluble metallic salts in fibers with crosslinked structure containing ion-exchangeable or ion-coordinable polar groups.

The present invention of producing such fine metallic particles-containing fibers includes the following three methods.

1. A method comprising applying metal ions to crosslinked fibers containing ion-exchangeable or ion-coordinable polar groups to thereby induce ion-exchange or ion-coordination in the polar groups with the metal ions, followed by reducing them to thereby precipitate fine metallic particles in the crosslinked fibers.

2. A method comprising applying metal ions or ions capable of bonding to metal ions to precipitate hardly-soluble metallic salts, to crosslinked fibers containing ion-exchangeable or ion-coordinable polar groups, thereby inducing ion-exchange or ion-coordination in the polar groups with the ions, followed by applying thereto a compound capable of precipitating hardly-soluble metallic coordination with anions or cations. Of the polar groups, anion-exchangeable groups include a primary amino group, a secondary amino group, a tertiary amino group, and a quaternary amino group; and cation-exchangeable groups include a phosphoric acid group, a phosphate group, a carboxyl group, a sulfonic acid group, and a sulfate group; and ion-coordinable groups include a carbonyl group, a hydroxyl group, a mercapto group, an ether group, an ester group, a sulfonyl group, and a cyano group. Of these groups, preferred are a primary amino group, a secondary amino group, a tertiary amino group, a quaternary amino group, a phosphoric acid group, a carboxyl group, a sulfonic acid group, and a cyano group, as producing good results. In particular, especially preferred is a carboxyl group that easily forms complexes or salts with metal ions.

The counter ions or ligand ions for the ion-exchangeable or ion-coordinable polar groups, which the polymer matrix in the fine metallic particles-containing fibers of the present invention has, are not specifically defined and can be suitably selected in accordance with the use of the fibers. It is also possible to make the counter ions or ligand ions have some favorable functions. For example, if a compound having, as the counter ion, a quaternary cation group is employed in the present invention, it is possible to enhance the advantages of the salts to thereby precipitate fine particles of a hardly-soluble metallic salt in the crosslinked fibers.

3. A method comprising applying metal ions or ions capable of bonding to metal ions to precipitate hardly-soluble metallic salts, to crosslinked fibers containing ion-exchangeable or ion-coordinable polar groups, thereby inducing ion-exchange or ion-coordination in the polar groups with the ions, then applying thereto a compound capable of precipitating hardly-soluble metallic salts to thereby precipitate fine particles of a hardly-soluble metallic salt in the crosslinked fibers, and thereafter reducing them to thereby precipitate fine particles of a metal and/or a hardly-soluble metallic salt in the crosslinked fibers.

Embodiments of Carrying out the Invention

Now, the present invention is described in detail hereinafter. Fibers or polymers with crosslinked structure are herein often referred to as crosslinked fibers or crosslinked polymers, as the case may be. The "fibers" are employed herein for the case where their morphology is specifically emphasized, while the "polymers" are employed for the case where their morphology is not specifically defined. The polar groups to be in the crosslinked polymers for use in the present invention are not specifically defined, provided that they can receive ion-exchange or ion-invention, for example, by making the fibers of the invention additionally have an antibacterial property or by enhancing the antibacterial property of the fibers of the invention.

The amount of the polar group which the crosslinked polymer or fibers shall have can be suitably determined, depending on the amount of the fine particles of a metal and/or a hardly-soluble metallic salt to be incorporated into the polymer or fibers. Since, however, the amount shall be one that is obtained by subtracting the amount of the skeleton-forming polymer moiety from that of the complete polymer, it may be 32 mmol/g or smaller. If the polymer is required to have fibrous properties in some degree, the amount of the polar group existing in the polymer is desirably 16 mmol/g or smaller. On the other hand, if the fibers are required to sufficiently express the effects the fine particles of a metal and/or a hardly-soluble metallic salt existing therein, it is in fact desirable that the fibers have a polar group of at least 0.01 mmol/g, preferably at least 1 mmol/g. The means of introducing such a polar group into the polymer is not specifically defined. For example, employable is a means of employing monomers having a polar group in the step of producing the skeleton polymer through polymerization of the monomers to thereby introduce the polar group into the resulting polymer, or a means of chemically or physically modifying a skeleton polymer already formed to thereby introduce a polar group into the polymer.

The basic skeleton of the polymer which is to be the matrix for use in the present invention is not specifically defined, provided that it has crosslinked structure. Any of natural polymers, semi-synthetic polymers and synthetic polymers can be used in the present invention. Specific examples of the polymer include plastics, such as polyethylene, polypropylene, polyvinyl chloride, ABS resins, nylons, polyesters, polyvinylidene chloride, polyamides, polystyrenes, polyacetals, polycarbonates, acrylic resins, fluorine-containing resins, polyurethane elastomers, polyester elastomers, melamine resins, urea resins, tetrafluoroethylene resins, unsaturated polyester resins, epoxy resins, urethane resins and phenolic resins; fibers, such as nylon, polyethylene, rayon, acetate, acrylic, polyvinyl alcohol, polypropylene, cupra, triacetate, vinylidene and the like fibers; natural rubbers, and also synthetic rubbers such as silicone rubber, SBR (styrene-butadiene rubber), CR (chloroprene rubber), EPM (ethylene-propylene rubber), FPM (fluorine-containing rubber), NBR (nitrile rubber), CSM (chlorosulfonated polyethylene rubber), BR (butadiene rubber), IR (synthetic natural rubber), IIR (butyl rubber), urethane rubber and acrylic rubber.

Above all, preferred are polymers having basic skeletons based on carbon-carbon bonds, since such have favorable characteristics resistant to physical and chemical changes that may follow the formation of fine particles of metals and/or hardly-soluble metallic salts therein, or, that is, have good heat resistance and chemical resistance. For example, preferred are vinylic polymers, especially those into which ion-exchangeable or ion-coordinable polar groups can be introduced with ease. Specific examples of such polymers include styrene polymers, acrylate polymers and acrylonitrile polymers. Use of these produces good results.

The crosslinked structure to be in the basic skeleton polymer that constitutes the fibers of the present invention is not specifically defined, provided that the polymer is not physically or chemically modified or deteriorated in the step of making it have fine particles of metals and/or hardly-soluble metallic salts therein. For example, it may be any of crosslinking with covalent bonds, ionic crosslinking, crosslinking resulting from the interaction of polymer molecules, and crystalline-structured crosslinking. The means of introducing such crosslinked structure into the polymer is not also specifically defined. However, since the polymer must form fibers, the introduction must be conducted after the formation of the polymer into fibers.

Fibers of polyacrylonitrile polymers with crosslinked structure with hydrazine are chemically and physically stable and have good fibrous properties. In addition, the fibers can have a high content of fine particles of metals and/or hardly-soluble metallic salts, and have high heat resistance, while their costs are low. Therefore, use of the fibers is preferred, as producing good results. In particular, especially preferred are the fibers of the type with crosslinked structure with hydrazine in which the increase in the nitrogen content therein to be caused by the hydrazine crosslinking is from 1.0 to 15.0% by weight, as producing better results. The increase in the nitrogen content as referred to herein indicates the difference in the nitrogen content between the original, non-crosslinked acrylic fibers and the hydrazine-crosslinked acrylic fibers.

The degree of crosslinking of the polymer matrix skeleton, which indicates the proportion of the crosslinked structure in the skeleton, is not also specifically defined, provided that the polymer matrix skeleton can still maintain its original shape even after the physical or chemical reaction that induces the formation of fine particles of metals and/or hardly-soluble metallic salts therein.

The fine particles of metals and/or hardly-soluble metallic salts as referred to herein are not specifically defined, provided that the hardly-soluble metallic salts can be reduced to give metal precipitates or are hardly water-soluble salts having a solubility product of $10^{-5}$ or less. As preferred examples of such metals and/or hardly-soluble metallic salts, mentioned are one or more metals selected from the group consisting of Cu, Fe, Ni, Zn, Ag, Ti, Co, Al, Cr, Pb, Sn, In, Zr, Mo, Mn, Cd, Bi, Mg, V, Ga, Ge, Se, Nb, Ru, Rh, Pd, Sb, Te, Hf, Ta, W, Re, Os, Ir, Pt, Au, Hg and Tl, and/or at least one or more selected from the group consisting of oxides, hydroxides, chlorides, bromides, iodides, carbonates, phosphates, chlorates, bromates, iodates, sulfates, sulfites, thiosulfates, thiocyanates, pyrophosphates, polyphosphates, silicates, aluminates, tungstates, vanadates, molybdates, antimonates, benzoates and dicarboxylates of such metals. Use of two or more these metals to give fine particles of the resulting alloys does not overstep the scope of the present invention. The amount of the metals and/or hardly-soluble metallic salts to be in the fibers of the present invention is not specifically defined but can be determined freely.

The size of the fine particles of metals and/or hardly-soluble metallic salts to be in the fibers of the present invention is not also specifically defined, but can be determined freely depending on the use of the fibers. However, where the surface characteristics of the fine particles are desired to be utilized, it is preferred that the size is as small as possible since finer particles can have larger surface areas. Suitably, therefore, the size is of sub-micron order of 1.0$\mu$ or smaller. Where the appearance of the fine particles of the volume thereof is desired to be utilized, the fine particles are required to have somewhat large particle sizes in some degree. In this case, for example, it is desirable to use fine particles having particle sizes of 10 $\mu$m or smaller.

The shape of the fine particles of metals and/or hardly-soluble metallic salts to be in the fibers of the present invention is not also specifically defined. For example, the fine particles may have any desired shapes, for example, selected from spherical, acicular, conical, rod-like, columnar, polyhedral and multiacicular shapes. The dispersion of the fine particles in the crosslinked polymer is not also specifically defined and can be suitably determined depending on the use of the fibers. In particular, the present invention is characterized in that the fine particles can be completely and uniformly dispersed in and carried by the entire fibers with ease. However, it is also possible to make the fibers have so-called domain structure having a difference in the concentration of the fine particles between the surface area and the center area. The mode of such fibers does not overstep the scope of the present invention.

The shape of the fibers of the present invention that contain fine particles of metals and/or hardly-soluble metallic salts is not specifically defined and can be freely determined depending on the use of the fibers. However, from the viewpoint of increasing the surface area per the unit weight of the fibers to thereby enhance the ability thereof to well express their effects, while effectively utilizing the effects of the metals and/or the hardly-soluble metallic salts existing inside the fibers, preferred are porous fibers as producing good results. Especially preferred are porous fibers having pore sizes of 1.0 $\mu$m or smaller, in which the pores are connected with one another and have openings on the surfaces of the fibers. Of such porous fibers, more preferred are those having a larger surface area and having a larger degree of porosity. In fact, use of porous fibers having a surface area of 1 $m^2/g$ or larger and a degree of porosity of 0.05 $cm^3/g$ or larger produces good results. However, porous fibers having pore sizes of larger than 1.0 $\mu$m are unfavorable, since their physical properties are poor and their surface area is reduced.

The surface area, the degree of porosity and the pore size as referred to herein are obtained from the cumulative forced volume (for the degree of porosity) and the cumulative surface area (for the internal surface area) as measured at 20,000 psi and at 200 psi with a mercury porosimeter. Precisely, they are obtained by calculating the difference between the data measured at 20,000 psi and those measured at 200 psi. The pressure range employed herein is to measure the pore sizes falling between 0.009 $\mu$m and 0.85 $\mu$m. At a pressure falling within the range, the ratio, pore volume/pore surface area, is obtained in terms of cylindrical pores.

In the method of the present invention, the step of ion-exchanging or ion-coordinating the polar groups with metal ions is not specifically defined. For example, the step can be conducted by bringing a compound with a metal ion into contact with the polymer matrix having polar groups. The compound with a metal ion may be any of inorganic compounds and organic compounds. In view of the easiness in the ion-exchanging or the ion-coordination, preferred are inorganic compounds as producing good results. The means of bringing the compound into contact with the polymer matrix is not also specifically defined. For example, employable is a process comprising dissolving metal ions in an organic solvent or water followed by contacting the polymer matrix with the resulting solution.

The reduction in the method of the present invention is not also specifically defined, provided that it can convert metal ions into metals. For example, employable is any of a means of using, as a reducing agent, a compound capable of donating electrons to metal ions, that may be selected from sodium borohydride, hydrazine, formalin, aldehyde group-having compounds, hydrazine sulfate, prussic acid and its salts, hyposulfurous acid and its salts, thiosulfates, hydrogen peroxide, Rochelle salt, glucose, alcohol group-having compounds, hypochlorous acid and its salts, and reducing metal ions in a solution containing such a reducing agent; a means of reducing metal ions through heat treatment in a reducing atmosphere comprising hydrogen, carbon monoxide, hydrogen sulfide or the like; a means of reducing metal ions through exposure to light; and combinations of these means.

To conduct the reduction in such a solution, it is possible to add to the reaction system any of pH regulating agents, for example, basic compounds such as sodium hydroxide and ammonium hydroxide, and also inorganic acids and organic acids; buffers, for example, hydroxycarboxylates such as sodium citrate and sodium lactate, boron, inorganic acids such as carbonic acid, organic acids, and alkali salts of inorganic acids; promoters such as sulfides and fluorides; stabilizers such as chlorides, sulfides and nitrides; and improvers such as surfactants, and the addition does not overstep the scope of the present invention. For the heat treatment in a reducing atmosphere, an inert gas such as nitrogen, argon, helium or the like may be in the atmosphere, also without overstepping the scope of the present invention.

The reduction to be conducted in the method of the present invention is not specifically defined, provided that it is to reduce the metal ions that have been ion-exchanged or ion-coordinated, to thereby precipitate fine metallic particles in the fibers. However, the reduction is preferably such that the metal ions are immediately reduced just after having been fixed on the polar groups in the crosslinked fibers through the ion-exchange of the metal ions for the ions in the polar groups, as producing good results. Apart from this, generally known is a process comprising once precipitating the ion-exchanged metal ions in the polymer matrix in the form of the corresponding metal compounds, and thereafter reducing the compounds to convert them into fine metallic particles. However, this process is unfavorable in view of the economical aspect, since the metal compounds are often precipitated not in the polymer matrix but out of it and since the metal compounds thus precipitated out of the polymer matrix are reduced to also give fine metallic particles not in the polymer matrix but out of it. It is believed that the behavior of metal compounds and that of the fine metallic particles in the polymer matrix will be caused by the change in the size of the precipitated compounds during the reaction, thereby resulting in the dropping of the compounds out of the pores of the polymer matrix. In view of these, it is especially preferred to conduct the reduction by heat treatment in the method of the present invention, which facilitates the complete incorporation of the ion-exchanged metal ions into the crosslinked fibers and which therefore produces good results.

The number of times of operation for reducing the ion-exchanged or ion-coordinated metal ions to be conducted in the method of the present invention may be one or, that is, the reduction may well be effected only once, if the intended or predetermined amount of fine metallic particles can be incorporated into the fibers through one reduction. However, if an increased amount of fine metallic particles is desired to be incorporated into the fibers, the operation for reduction can be repeated several times until the intended, increased amount of fine metallic particles are incorporated into the fibers. Anyhow, the reduction can be effected in any way, depending on the object and the use of the fibers to be obtained herein. In particular, the repetition of the reduction is often preferred, as being able to increase the content of the fine metallic powders per the unit weight of the polymer matrix and as producing good results.

The ions or compounds capable of bonding to metallic ions to give hardly-soluble metallic salts precipitated in fibers, which are used in the method of the present invention, are not specifically defined, but include, for example, hydroxide ion, chlorine, bromine, iodine, carbonic acid, phosphoric acid, chloric acid, bromic acid, iodic acid, sulfuric acid, sulfurous acid, thiosulfuric acid, thiocyanic acid, pyrophosphoric acid, polyphosphoric acid, silicic acid, aluminic acid, tungstic acid, vanadic acid, molybdic acid, antimonic acid, benzoic acid, and dicarboxylic acids. Where metal ions are first introduced into the polar groups in the fibers through ion-exchange or ion-coordination, the resulting compounds may give hardly-soluble metallic salts precipitated in the crosslinked fibers. However, where the above-mentioned ions capable of bonding to metallic ions are first introduced into the polar groups in the fibers through ion-exchange or ion-coordination, metallic compounds containing the metal ions of the intended, hardly-soluble metallic salts and capable of precipitating the intended, hardly-soluble metallic salts are thereafter added to the fibers by which the intended, hardly-soluble metallic salts are precipitated in the crosslinked fibers.

In the method of the present invention for producing deodorizing fibers, if the fine metallic particles and the fine particles of hardly-soluble metal salts as precipitated in the fibers have different deodorizing properties for different odor components, it is desirable to precipitate both the metals and the hardly-soluble metallic salts in the fibers. For example, if the hardly-soluble metallic salts precipitated are better for absorbing nitrogen compounds while the metals precipitated are better for absorbing sulfur compounds, it is preferred to make the crosslinked fibers carry both of these thereby being able to exhibit broader deodorizing capacity. In order to precipitate fine particles of hardly-soluble metallic salts and to partly reduce hardly-soluble metallic salts into metals in the method of the present invention for precipitating metals and hardly-soluble metallic salts in crosslinked fibers, the same means as those mentioned hereinabove for the precipitation of hardly-soluble metallic salts and for the reduction of the salts into metals shall apply thereto.

EXAMPLES

Now, the present invention is described concretely here in under with reference to the following examples, which, however, are not intended to restrict the scope of the present invention. In the examples, all parts and percentages are by weight, unless otherwise specifically indicated.

Example 1

10 parts of an AN polymer (having a limiting viscosity [η] in dimethylformamide at 30° C. of 1.2) comprised of 90% of AN and 10% of methyl acrylate (hereinafter referred to as MA) was dissolved in 90 parts of an aqueous solution of 48% sodium rhodanate to prepare a spinning solution, which was then spun and stretched (to a whole stretching magnification of 10 times) in an ordinary manner, and thereafter dried in an atmosphere at dry-bulb temperature/wet-bulb temperature=120° C./60° C. (to a degree of shrinkage of 14%) to obtain a raw fiber sample Ia having a single fiber strength of 1.5 g/d.

The raw fiber sample Ia was put into an aqueous solution of 10% hydrazine, in which it was crosslinked with hydrazine at 120° C. for 5 hours. The thus-obtained, crosslinked fiber sample was washed with water, dewatered, and then put into an aqueous solution of 10% sodium hydroxide, in which it was hydrolyzed at 120° C. for 5 hours. After having been washed with water, dewatered and dried, a processed fiber sample Ib was obtained. The increase in nitrogen in the sample Ib was 2.5%, and the sample Ib had a carboxyl content of 4.2 mmol/g.

The fiber sample Ib was put into an aqueous solution of 10% silver nitrate, then subjected to ion-exchanging reaction therein at 80° C. for 30 minutes, and thereafter washed, dewatered and dried to obtain a silver ion-exchanged fiber sample Ic. This was thereafter heat-treated at 180° C. for 30 minutes. As a result of this process, obtained was a fine metallic particles-containing fiber sample Id of the present invention, which contained 6.5% of fine silver particles having a mean particle size of 0.02 μm.

Example 2

In the same manner as in Example 1, except that the silver ion-exchanged fiber sample Ic was dipped in an aqueous solution of 10% hydrazine and reduced at 50° C. for 20 minutes, obtained was a fine metallic particles-containing fiber sample IId of the present invention.

Example 3

An AN polymer as prepared to have a composition of acrylonitrile/methyl acrylate/sodium methallylsulfonate=95/4.7/0.3 was dissolved in an aqueous solution of 48% sodium rhodanate to prepare a spinning stock. Next, this spinning stock was spun into an aqueous solution of 12% sodium rhodanate at 5° C., then washed with water, and stretched by 10 times. The thus-obtained, non-dried fiber sample was wet-heated with steam at 130° C. for 10 minutes, and then dried at 100° C. for 20 minutes to obtain a porous raw fiber sample IIIb having a mean pore size of 0.04 μm. Next, this was processed in the same manner as in Example 1 to be converted into a fine metallic particles-containing fiber sample IIId.

Example 4

60 parts of DMF was mixed with 17.5 parts of glycerin in a container while stirring. Next, 22.5 parts of an acrylonitrile copolymer comprised of 93.6% of acrylonitrile, 5.7% of methyl acrylate and 0.7% of sodium methallylsulfonate was added thereto, while stirring, and the stirring was continued at 80° C. for 1 hour. Next, after having been filtered, the resulting liquid was dry-spun by passing it through a spinneret with 500 orifices at a spinning duct temperature of 180° C. in an ordinary manner. The viscosity of the liquid having a solid content of 22.5% and a glycerin content of 17.5% was 85 dropping-ball seconds. Next, the tow thus obtained was stretched in boiling water at a ratio of 1:3.6, and then washed in boiling water for 3 minutes while light tension was applied thereto. Next, this was dried in a screen drum drier at an acceptable shrinkage of 10% and at a temperature of 100° C. to obtain a porous raw fiber sample IVb having a mean pore size of 0.17 μm. Next, this fiber sample was processed in the same manner as in Example 1 to be converted into a fine metallic particles-containing fiber sample.

Example 5

The raw material sample Ia as obtained in Example 1 was crosslinked with hydrazine, then washed, dewatered and dried in the same manner as in Example 1, but was not hydrolyzed. Thus was obtained a raw fiber sample Vb with nitrile group remained therein. The thus-obtained fiber sample was subjected to silver ion-exchange in the same manner as in Example 1 to thereby make fine silver particles precipitated therein. Thus was obtained a fine metallic particles-containing fiber sample of the present invention.

The characteristic data of the fiber samples produced in Examples 1 to 5, and also the data thereof as obtained by testing them are shown in Table 1.

TABLE 1

| | Example 1 | Example 2 | Example 3 | Example 4 | Example 5 |
|---|---|---|---|---|---|
| Polar Group | Carboxyl Group | Carboxyl Group | Carboxyl Group | Carboxyl Group | Nitrile Group |
| Polar Group Content | 4.2 mmol/g | 5.1 mmol/g | 4.5 mmol/g | 4.8 mmol/g | 8.3 mmol/g |
| Pore Size | | | 0.04 μm | 0.17 μm | |
| Surface Area | | | 55 $m^2/g$ | 25 $m^2/g$ | |

TABLE 1-continued

| | Example 1 | Example 2 | Example 3 | Example 4 | Example 5 |
|---|---|---|---|---|---|
| Porosity | | | 0.2 $cm^3/g$ | 0.66 $cm^3/g$ | |
| Type of Metal | Ag | Ag | Ag | Ag | Ag |
| Means of Reduction | Heat | Hydrazine | Heat | Heat | Heat |
| Metal Content | 15.0% | 9.0% | 11.0% | 8.0% | 3.0% |
| Size of Fine Metallic Particles | 0.02 μm | 0.5 μm | 0.01 μm | 0.03 μm | 0.01 μm |
| Fiber Strength | 1.6 g/d | 1.5 g/d | 1.4 g/d | 1.5 g/d | 2.6 g/d |
| Fiber Elongation | 31% | 18% | 25% | 28% | 39% |
| Knot Strength | 1.3 g/d | 1.0 g/d | 1.2 g/d | 1.4 g/d | 1.8 g/d |

As in Table 1, it is obvious that the samples of the present invention in Examples 1 to 5 all have good fiber properties, fiber strength, elongation and knot strength to such degree that the spun fibers can be post-processed, and all contain extremely fine metallic particles at high concentrations. The samples in Examples 3 and 4 are porous fibers containing fine metallic particles therein.

Examples 6 to 10

In the same manner as in Example 3, except that the type of the fine metallic particles to be in the fibers and the reducing agent to be employed were varied to those as in Table 2, obtained were fine metallic particles-containing fiber samples of the present invention in Examples 6 to 10. The physical properties and the characteristics of the fiber samples obtained herein are shown in Table 2.

TABLE 2

| | Example 6 | Example 7 | Example 6 | Example 9 | Example 10 |
|---|---|---|---|---|---|
| Aqueous Solution of Metal Salt | Copper Sulfate | Nickel Sulfate | Palladium Chloride | Zinc Sulfate | Stannous Chloride + Nickel Chloride |
| Type of Metal | Cu | Ni | Pd | Zn | Sn/Ni |
| Reducing Agent | Formalin | Hypo-phos-phorous Acid | $NaBH_4$ | Hypo-phos-phorous Acid | Hypo-phosphorous Acid |
| Metal Content | 7.0% | 3.5% | 6.3% | 2.9% | 6.6% |
| Size of Fine Metallic Particles | 0.3 μm | 0.1 μm | 0.4 μm | 0.05 μm | 0.05 μm |
| Fiber Strength | 1.9 g/d | 1.8 g/d | 1.5 g/d | 1.9 g/d | 1.8 g/d |
| Fiber Elongation | 27% | 31% | 20% | 28% | 31% |
| Knot Strength | 1.6 g/d | 1.5 g/d | 1.1 g/d | 1.8 g/d | 1.6 g/d |

As in Table 2, it is obvious that the pore fibers of the present invention as obtained in Examples 6 to 10 all contain various fine metallic particles, and that, like those in Table 1, they all have good fiber properties, fiber strength, elongation and knot strength to such degree that the spun fibers can be post-processed.

Comparative Example 1

The raw fiber sample Ia obtained in Example 1 was crosslinked and hydrolyzed by heating it in an aqueous solution comprising 3% of sodium hydroxide and 0.01% of hydrazine, at 100° C. for 20 minutes, then washed with water, treated with an aqueous solution of 0.5% acetic acid at 100° C. for 20 minutes, then again washed with water, and dried. Thus was obtained a raw material fiber sample ib having carboxyl group on its surface. This sample ib was dipped in an aqueous solution of 0.5% silver nitrate at 40° C. for 10 minutes, then washed with water, and dried. Thus was obtained a silver ion-bonded acrylic fiber sample ic containing silver ions as bonded thereto. Next, this sample ic was dipped in an aqueous solution of 0.5% sodium carbonate at 70° C. for 30 minutes to thereby make silver carbonate precipitated in the fiber sample, which was then washed with water, dewatered, dried and thereafter hot-dried in a hot air drier at 130° C. for 30 minutes. Thus was obtained a comparative fiber sample id having fine silver particles on its surface. The silver content of this sample id was 1.5%. The size of the fine silver particles as bonded to the surface of the sample id was 0.05 μm. The silver concentration in the acrylic fiber with silver ion as bonded thereto through ion-exchange and the silver ion concentration in the finally-obtained, fine silver particles-containing fiber sample are shown in Table 3, in comparison with those in Examples 1 and 3. As in Table 3, the silver concentration in the final fiber sample as obtained in Comparative Example 1 according to the method of once precipitating the metal compound in the fiber and thereafter reducing the compound was lowered to less than a half of the silver concentration in the intermediate fiber having ion-exchanged silver ions therein. It is known that the method employed in Comparative Example 1 is unfavorable since the utilization of silver ions is poor. As opposed to this, all the silver ions as incorporated into the fibers through ion-exchange were still in the final fibers in Examples 1 and 3 of the present invention. It is known that the utilization of silver ions in the method of the present invention is good.

TABLE 3

| | Example 1 | Example 3 | Comparative Example 1 |
|---|---|---|---|
| Ag content of Ag ion-exchanged Fiber | 15.0% | 11.0% | 3.2% |
| Ag Content of Final Fiber | 15% | 11.0% | 1.5% |
| Ag Content of Knitted Fabric | 14.0% | 9.5% | 0.02% |

The fiber samples of Examples 1 and 3 and Comparative Example 1 each were mixed-spun at a mixing ratio of 30%, then post-processed and knitted to give knitted fabrics. The silver content of each fiber sample and that of each knitted fabric sample were measured, and the data obtained are shown in Table 3. As in Table 3, it is known that the silver content of the knitted fabric of Comparative Example 1 was greatly lowered. This is considered because the fine silver particles existing on the surface of the fiber peeled off in the post-processing step that followed the spinning step, due to the friction of the fiber against metal parts such as guides in the apparatus used. It is obvious that not only the effects of the metal in the fiber of Comparative Example 1 could not be satisfactorily utilized but also the fiber of Comparative Example 1 is disadvantageous from the viewpoint of its cost. On the other hand, some reduction in the silver content of the knitted fabrics in Examples 1 and 3 was found but the degree of the reduction was only small. The final silver content of the knitted fabrics in Examples 1 and 3 is thus satisfactorily, and these knitted fabrics are practicable.

The fibers of Examples 1 and 3 and Comparative Example 1 were each sheeted into mixed paper of 130 g/m$^2$. The mixed paper was comprised of vinylon of 1%, each fiber (its content is shown in Table 4) and the balance of pulp. Each paper sample was tested for the reduction in cells of *Klebsiella pneumoniae* according to the shaking-in-flask method, and for the resistance to fungi according to the wet method of JIS Z 2911. The reduction in cells indicates the percentage of the reduction in cells relative to the control. The larger the value, the higher the antibacterial property of the sample tested. For the resistance to fungi, fungi were grown on each sample for 14 days, and the sample was evaluated according to the following three ranks that were classified on the basis of the results of the fungi-growing test.

1: Fungi grew in ⅓ or more of the surface area of the sample.

2: Fungi grew in less than ⅓ of the surface area of the sample.

3: No fungi grew.

TABLE 4

| | Example 1. id | Example 1, Id | Example 3, IIId | Example 3' IIId | Comparative Example 1, id | Comparative Example 1, id |
|---|---|---|---|---|---|---|
| Proportion of Fine Metallic Fiber-containing Fiber (%) | 2 | 10 | 2 | 10 | 10 | 50 |
| Reduction in Cells of *Klebsiella pneumoniae* | 85 | 99.9 | 98.0 | 99.9 | 0.1 or less | 38 |
| Resistance to Fungi | 2 | 3 | 3 | 3 | 1 | 1 |

As in Table 4, it is known that both the antibacterial property and the fungi resistance of the samples of Comparative Example 1 are poor. This is considered because, since the fine silver particles exist only on the surface of the fiber, the silver content of the samples is low. The fungi resistance especially requires a high silver content. Therefore, the sample of Comparative Example 1, even though containing 50% of the fine silver particles-containing fiber, had still poor fungi resistance. It may be considered that both the antibacterial property and the fungi resistance will increase if the content of the fine silver particles-containing fiber is increased. However, the increase in the content of the fine silver particles-containing fiber results in the increase in the cost of the product, and the product will lose its practicability. As opposed to the samples of Comparative Example 1, the samples of Examples 1 and 3 were found to exhibit good antibacterial property and fungi resistance, even though containing only 2% of the fine silver particles-containing fiber. This is considered because the samples of Examples 1 and 3 had a higher silver content than those of Comparative Example 1 and therefore easily expressed the functions of the fine silver particles. The effects of silver are especially remarkable in the porous samples of Example 3. The sample of Example 3, even containing only 2% of the fine silver particles-containing fiber, expressed almost completely the antibacterial property and the fungi resistance. This is considered because, since the porous fiber had an enlarged surface area, the amount of the fine silver particles existing in the fiber and capable of being contacted with outer substances was greatly increased, and since the porous fiber had pores even in its inside, the amount of the fine silver particles existing in the fiber and capable of expressing their effects was substantially increased.

Now, examples of the deodorizing fibers of the present invention that contain fine particles of metals and/or hardly-soluble metallic salts are described below.

The degree of deodorization, the size of pores in porous fibers, and the porosity of fibers were obtained according to the methods mentioned below.

(1) Degree of Deodorization (%):

2 g of a dry fiber sample to be tested was conditioned at 20° C. and at a relative humidity of 65%, and put into a TEDLAR BAG® BAG (trademark of DuPont for polyvinyl flouride), which was then sealed and degassed. One liter of air at 20° C. and at a relative humidity of 65% was introduced into the bag, and then a gas containing odor components was injected thereinto to be 30 ppm. Then, the bag was left under the above-mentioned condition. After 2 hours, the concentration of the odor components-containing gas in the bag was measured, using a detecting tube (A ppm). From the data, the degree of deodorization of the sample was obtained according to following equation. The test for determining the degree of deodorization was entirely carried out at an atmospheric pressure (1 atm).

Degree of Deodorization (%)=[(30-A)/30]×100

(2) Pore Size ($\mu$m):

Using a Simadzu Micromelitex Poresizer, 9310 Model, the pore size of the pores in a fiber sample was measured.

(3) Porosity (cm$^3$/g):

A fiber sample to be tested was dried in a vacuum drier at 80° C. for 5 hours, and its dry weight (B g) was obtained. Next, the sample was dipped in pure water at 20° C. for 30 minutes, and then centrifugally dewatered for 2 minutes, and its wet weight (C g) was obtained. From these, obtained was the porosity of the sample according to the following equation.

$$\text{Porosity (cm}^3\text{/g)}=(C-B)/B$$

Example 1'

10 parts of an acrylonitrile polymer (having a limiting viscosity [η] in dimethylformamide at 30° C. of 1.2) comprised of 90% of acrylonitrile and 10% of methyl acrylate (hereinafter referred to as MA) was dissolved in 90 parts of an aqueous solution of 48% sodium rhodanate to prepare a spinning stock, which was then spun and stretched (to a whole stretching magnification of 10 times) in an ordinary manner, and thereafter dried in an atmosphere at dry-bulb temperature/wet-bulb temperature=120° C./60° C. (to a degree of shrinkage of 14%) to obtain a raw fiber sample I'a having a single fiber diameter of 38 $\mu$m.

The raw fiber sample I'a was put into an aqueous solution of 10% hydrazine, in which it was crosslinked with hydrazine at 120° C. for 3 hours. The thus-obtained, crosslinked fiber sample was washed with water, dewatered, and then put into an aqueous solution of 10% sodium hydroxide, in which it was hydrolyzed at 100° C. for 1 hour. After having been washed with water, dewatered and dried, a processed fiber sample I'b was obtained. The increase in nitrogen in the sample I'b was 1.7%, and the sample I'b had a carboxyl content of 1.3 mmol/g.

The fiber sample I'b was put into an aqueous solution of 5% silver nitrate, then subjected to ion-exchanging reaction therein at 80° C. for 30 minutes, and thereafter washed, dewatered and dried to obtain a silver ion-exchanged fiber sample I'c. This was thereafter heat-treated at 180° C. for 30 minutes. As a result of this process, obtained was a fine metallic particles-containing fiber sample of the present invention, which contained 1.6% of fine silver particles having a mean particle size of 0.02 μm. The mean particle size of the silver particles was calculated by observing the surface and the inside of the fiber sample with a transmission electron microscope (TEM). The silver content was measured according to the atomic absorption method, after the fiber sample was wet-decomposed in a thick solution of nitric acid, sulfuric acid or perchloric acid.

Example 2'

The silver ion-exchanged fiber sample I'c was put into an aqueous solution of 5% sodium hydroxide and treated therein at 50° C. for 20 minutes. As a result of this treatment, obtained was a fiber sample II'd of the invention, which contained 1.7% of fine, hardly-soluble silver oxide particles.

Example 3'

The fiber sample I'a was put into an aqueous solution of 10% hydrazine, and crosslinked with hydrazine at 100° C. for 3 hours. The thus-obtained, crosslinked fiber sample was then washed with water, dewatered, put into an aqueous solution of 0.50% N,N-dimethyl-1,3-diaminopropane, and aminated therein at 105° C. for 5 hours. After having been washed, dewatered and dried, obtained was a fiber sample III'b having a tertiary amino group content of 2.1 mmol/g.

The fiber sample III'b was put into an aqueous solution of 5% sodium thiocyanate, then ion-exchanged therein at 80° C. for 30 minutes, washed, dewatered, thereafter put into an aqueous solution of 5% silver nitrate, and treated therein at 80° C. for 30 minutes. As a result of this treatment, obtained was a fiber sample of the invention, which contained 2.1% of fine, hardly-soluble silver thiocyanate particles.

Example 4'

The fine, hardly-soluble metallic salt particles-containing fiber sample II'd was dipped in an aqueous solution of 1% hydrazine, and reduced therein at 30° C. for 10 minutes. As a result of this reduction, obtained was a fiber sample of the present invention, which contained 0.6% of fine silver particles and 1.3% of fine, hardly-soluble silver oxide particles. To quantify the silver oxide content and the silver content of this sample, silver oxide in the sample was separated by dissolving it in an aqueous ammonia.

Example 5'

In the same manner as in Example 1', except that the silver ion-exchanged fiber sample I'c was dipped in an aqueous solution of 10% hydrazine and reduced at 50° C. for 20 minutes, obtained was a fine metallic particles-containing fiber sample of the present invention.

Example 6'

An acrylonitrile polymer as prepared to have a composition of acrylonitrile/methyl acrylate/sodium methallylsulfonate=95/4.7/0.3 was dissolved in an aqueous solution of 48% sodium rhodanate to prepare a spinning stock. Next, this spinning stock was spun into an aqueous solution of 12% sodium rhodanate at 5° C., then washed with water, and stretched by 10 times. The thus-obtained, non-dried fiber sample was wet-heated with steam at 130° C. for 10 minutes, and then dried at 100° C. for 20 minutes to obtain a porous raw fiber sample VI'a having a mean pore size of 0.04 μm. Next, this was processed in the same manner as in Example 1' to be converted into a fine metallic particles-containing fiber sample of the present invention.

Example 7'

60 parts of dimethylformamide was mixed with 17.5 parts of glycerin in a container while stirring. Next, 22.5 parts of an acrylonitrile copolymer comprised of 93.6% of acrylonitrile, 5.7% of methyl acrylate and 0.7% of sodium methallylsulfonate was added thereto, while stirring, and the stirring was continued at 80° C. for 1 hour. Next, after having been filtered, the resulting liquid was dry-spun by passing it through a spinneret with 496 orifices in an ordinary manner. The spinning duct temperature was 180° C. The viscosity of the liquid having a solid content of 22.5% and a glycerin content of 17.5% was 85 dropping-ball seconds. Next, the tow thus obtained was stretched in boiling water at a ratio of 1:3.6, and then washed in boiling water for 3 minutes while light tension was applied thereto. Next, this was dried in a screen drum drier at an acceptable shrinkage of 10% and at a temperature of 100° C. to obtain a porous raw fiber sample having a mean pore size of 0.17 μm. Next, this fiber sample was processed in the same manner as in Example 1' to be converted into a fine metallic particles-containing fiber sample of the present invention.

Example 8'

The raw material sample I'a as obtained in Example 1' was crosslinked with hydrazine, then washed, dewatered and dried in the same manner as in Example 1', but was not hydrolyzed. Thus was obtained a raw fiber sample with nitrile group remained therein. The thus-obtained fiber sample was subjected to silver ion-exchange in the same manner as in Example 1' to thereby make fine silver particles precipitated therein. Thus was obtained a fine metallic particles-containing fiber sample of the present invention.

Example 9'

In the same manner as in Example 1', except that a nozzle having a smaller diameter was used in the spinning to prepare a raw fiber sample having a single fiber diameter of 17 μm, obtained was a fine metallic particles-containing fiber sample of the present invention.

Comparative Example 1'

A spinning stock, to which had been added silver particles having a mean particle size of 4.6 μm, was spun in the same manner as in Example 1' to obtain a comparative sample of silver particles-containing fibers. This sample contained 1.8% of silver particles.

Comparative Example 2'

Spinning of a spinning stock, to which had been added the same amount, as that in Comparative Example 1', of silver particles having a mean particle size of 4.6 μm, was tried herein in the same manner as in Example 1' to obtain raw fibers, except that the same nozzle as that used in Example 9' was used herein. However, the intended fibers could not be obtained as being cut during the spinning.

The fiber samples obtained in Examples 1' to 9' and Comparative Example 1' (in Comparative Example 2', fibers were not obtained) were tested to determine their deodorizability and other characteristics, and the data obtained are shown in Table 5. The samples of Examples 1' to 9' all had high deodorizability and could not be differentiated from one another in the deodorizability by the above-mentioned method of determining the degree of deodorization. In this, therefore, the amount of each sample to be tested was varied to 0.5 g, and the sample was tested according to the method to determine the degree of deodorization thereof. The data obtained in this manner are also shown in Table 5. The carboxyl group content and the tertiary amino group content of each sample were determined through potentiometry, while the nitrile group content thereof was determined through the measurement of the infrared absorption intensity with being compared with the standard substance.

TABLE 5

| | Example 1' | Example 2' | Example 3' | Example 4' | Example 5' | Example 6' | Example 7' | Example 8' | Example 9' | Comp. Example 1' | Comp. Example 2' |
|---|---|---|---|---|---|---|---|---|---|---|---|
| Diameter of Raw Fiber Added (μm) | 38 | | | | | | | | 17 | 38 | 17 |
| Polar Group | Carboxyl Group | Carboxyl Group | Tertiary Amino Group | Carboxyl Group | Carboxyl Group | Carboxyl Group | Carboxyl Group | Nitrile Group | Carboxyl Group | | |
| Polar Group Content | 1.3 | 1.5 | 2.1 | 1.4 | 1.4 | 1.4 | 1.5 | 8.3 | 1.5 | | |
| Pore Size (μm) | — | — | — | — | — | 0.04 | 0.17 | — | — | — | — |
| Porosity ($cm^3/g$) | — | — | — | — | — | 0.24 | 0.71 | — | — | — | — |
| Type of Fine Particles | Ag | $Ag_2O$ | AsSCN | $Ag/Ag_2O$ | Ag | Ag | Ag | Ag | Ag | Ag | Ag |
| Reduction Method | Heat | — | — | Hydrazine | Hydrazine | Heat | Heat | Heat | Heat | — | — |
| Metal Content (%) | 1.6 | — | — | 0.6 | 1.4 | 1.6 | 1.3 | 0.9 | 1.8 | 1.8 | — |
| Metallic Salt Content (%) | — | 1.7 | 2.1 | 1.3 | — | — | — | — | — | — | — |
| Mean Particle Diameter of Fine Particles (μm) | 0.02 | 0.3 | 0.4 | 0.5 | 0.5 | 0.02 | 0.03 | 0.01 | 0.02 | 4.6 | 4.6 |
| Degree of Deodorization of Ammonia (%) | | | | | | | | | | | |
| Amount of Sample Tested: 2 g | 100 | 65 | 56 | 80 | 92 | 100 | 100 | 66 | 100 | 4 | — |
| Amount of Tested: 0.5 g | 99 | 46 | 32 | 68 | 84 | 100 | 100 | 52 | 100 | 2 | — |
| Degree of Deodorization of Hydrogen Sulfite (%) | | | | | | | | | | | |
| Amount of Tested: 2 g | 100 | 100 | 100 | 100 | 82 | 100 | 100 | 92 | 100 | 3 | — |
| Amount of Tested: 0.5 g | 98 | 100 | 100 | 99 | 71 | 100 | 100 | 86 | 98 | 1 | — |
| Fiber Strength (g/d) | 1.4 | 1.2 | 0.9 | 1.2 | 1.3 | 1.3 | 1.5 | 2.6 | 1.5 | 3.1 | — |
| Fiber Elongation (%) | 32 | 35 | 39 | 33 | 31 | 25 | 27 | 40 | 33 | 45 | — |
| Knot Strength (g/d) | 1.1 | 0.9 | 0.6 | 1.0 | 1.0 | 0.9 | 1.3 | 2.0 | 1.3 | 2.8 | — |

As in Table 5, it is known that the samples of Examples 1' to 9' of the present invention all have good deodorizability, still having good fiber properties, fiber strength, elongation and knot strength to such degree that the fibers can be post-processed. In particular, the porous fiber samples with fine metallic particles therein of Examples 6' and 7' have much better deodorizability than the others, since odor components can easily reach the fine metallic particles existing inside the fibers. As opposed to these, however, the sample of Comparative Example 1' has almost no deodorizability, since the deodorizing particles therein are too large, while having small surface areas, and therefore could not exhibit deodorizability. In Comparative Example 2', no fiber was obtained, and the tests were not carried out.

Examples 10' to 15'

In Examples 10' to 12', obtained were fine metallic particles-containing fiber samples of the present invention in the same manner as in Example 6', except that the type of the fine metallic particles and the reducing agent used were changed to those in Table 6. In Examples 13' to 15', obtained were fine, hardly-soluble metallic salt particles-containing fiber samples of the present invention in the same manner as in Example 2', except that the type of the hardly-soluble metallic salt added to the porous raw fiber sample VI'a and that of the compound used for precipitating the hardly-soluble metallic salt in fibers were varied to those in Table 6. The deodorizability and other characteristics of the fiber samples obtained herein are shown in Table 6.

TABLE 6

| | Example 10' | Example 11' | Example 12' | Example 13' | Example 14' | Example 15' |
|---|---|---|---|---|---|---|
| Type of Fine Particles | Cu | Zn | Ni | $(COOAg)_2$ | $Cu(OH)_2$ | $CdCO_3$ |
| Aqueous Solution of Metallic Salt | $CuSO_4$ | $ZnSO_4$ | $NiSO_4$ | $AgNO_3$ | $CuSO_4$ | $Cd(NO_3)_2$ |
| Agent for Forming | — | — | — | $(COOH)_2$ | NaOH | $NaCO_3$ |
| Reducing Agent | Formalin | Hypophosphorous Acid | Hypophosphorous Acid | — | — | — |
| Metal Content (%) | 1.1 | 0.4 | 1.6 | — | — | — |
| Metallic Salt Content (%) | — | — | — | 2.1 | 0.7 | 1.3 |
| Degree of Deodorization of Ammonia (%) | 93 | 82 | 77 | 100 | 27 | 85 |
| Degree of Deodorization of Hydrogen Sulfite (%) | 44 | 13 | 29 | 100 | 100 | 31 |
| Fiber Strength (g/d) | 1.4 | 1.6 | 1.7 | 1.3 | 1.1 | 1.5 |
| Fiber Elongation (%) | 24 | 27 | 25 | 23 | 28 | 25 |
| Knot Strength (g/d) | 1.1 | 1.4 | 1.3 | 1.2 | 0.9 | 1.1 |

As in Table 6, it is known that the pore fiber samples of Examples 10' to 15' of the present invention all have therein fine particles of a metal or hardly-soluble metallic salt and have good deodorizability, while still having good fiber properties, short fiber strength, elongation and knot strength to such degree that the fibers can be post-processed.

Advantages of the Invention

The fibers of the present invention, as containing therein fine particles of metals and/or hardly-soluble metallic salts, have various functions intrinsic to such fine metallic particles, such as antibacterial property, antifungal property, odor-repelling property, deodorizing property, flame-retarding property, ultraviolet-preventing property, heat-retaining property, surface-improving property, designed property, refreshing property, electroconductive property, rust-preventing property, lubricative property, magnetic property, light-reflecting property, selectively light-absorbing property, heat-absorbing property, heat-conductive property, and heat-reflecting property. In addition, since the fibers can be well processed and worked, they can be processed and worked to give worked products, such as paper, non-woven fabric, knitted fabric and woven fabric. Therefore, while utilizing such their effects, the fibers of the present invention can be used in various fields.

In particular, where the fibers contain both metals and hardly-soluble metallic salts, they can exhibit broad deodorizability. For example, where odor components comprising both hydrogen sulfide and ammonia are desired to be removed, and especially where it is desired to remove the acidic hydrogen sulfide odor, the fibers may be made to contain basic, hardly-soluble metallic salts, such as silver oxide, thereby exhibiting much better deodorizability to hydrogen sulfite. In addition, if the fibers are made to contain both silver oxide and silver, they can deodorize even alkaline ammonia odors. The fibers of the present invention can be produced, for example, according to the three methods mentioned hereinabove, which can suitably employed depending on the chemical properties of raw fibers used and on the use of the final products to be produced.

As having good processability and workability, the fibers of the present invention can be processed and worked into various types of products, such as non-woven fabric, woven fabric, knitted fabric and paper, and can also be applied to various substrates to make them have fibrous fluffy surfaces. Therefore, the fibers of the present invention can be used in various fields where deodorization is required. For example, the fibers can be used in producing water-purifying elements such as filters in drainage; elements in air-conditioning devices, such as filters in air conditioners, filters in air purifiers, air filters in clean rooms, filters in dehumidifiers, gas-treating filters in industrial use; clothing such as underwear, socks, stockings; bedding such as quilts, pillows, sheets, blankets, cushions; interior goods such as curtains, carpets, mats, wallpapers, stuffed toys, artificial flowers, artificial trees; sanitary goods such as masks, shorts for incontinence, wet tissues; car goods such as seats, upholstery; toilet goods such as toilet covers, toilet mats, toilets for pets; kitchen goods such as linings of refrigerators and trash cans; and also pads in shoes, slippers, gloves, towels, floor clothes, mops, linings of rubber gloves, linings of boots, sticking materials, garbage processors, etc.

When combined or mixed with other fibers, the fibers of the present invention can be more effectively used in various fields such as those mentioned above. For example, where the fibers of the invention are used as pads in quilts or as non-woven fabrics, they can be mixed with other fibers of, for example, polyesters to be bulky. Where the fibers are mixed with other absorbing materials, such as acidic gas-absorbing materials, it is possible to obtain absorbent goods usable in much broader fields. Thus, the fibers of the present invention can be combined with other various materials, thereby making them have additional functions while reducing the proportion of the fibers in products.

What is claimed is:

1. Fine metallic particles-containing fibers, having ion-exchangeable or ion-coordinable polar groups, having crosslinked structure, and containing throughout fine particles of a substantially insoluble metal and a substantially insoluble metallic salt.

2. Fine metallic particles-containing fibers as claimed in claim 1, wherein the fine particles of a metal and/or a substantially insoluble metallic salt are those of one or more metals selected from the group consisting of Cu, Fe, Ni, Zn, Ag, Ti, Co, Al, Cr, Pb, Sn, In, Zr, Mo, Mn, Cd, Bi, Mg, V, Ga, Ge, Se, Nb, Ru, Rh, Pd, Sb, Te, Hf, Ta, W, Re, Os, Ir, Pt, Au, Hg and Tl, and/or one or more substantially insoluble metallic salts thereof selected from the group consisting of oxides, hydroxides, chlorides, bromides, iodides, carbonates, phosphates, chlorates, bromates, iodates, sulfates, sulfites, thiosulfates, thiocyanates, pyrophosphates, polyphosphates, silicates, aluminates, tungstates, vanadates, molybdates, antimonates, benzoates and dicarboxylates of such metals.

3. Fine metallic particles-containing fibers as claimed in claim 1, wherein the fibers that contain fine particles of a metal and/or a substantially insoluble metallic salt are porous fibers having pores with pore sizes of 1.0 $\mu$m or smaller and wherein the pores are connected with one another and have openings on the surfaces of the fibers.

4. Fine metallic particles-containing fibers as claimed in claim 1, wherein the fibers that contain fine particles of a metal and/or a substantially insoluble metallic salt are of a crosslinked acrylonitrile polymer as crosslinked with hydrazine and wherein 0.1% by weight or more of the nitrile groups remaining in the polymer have been converted into carboxyl groups.

5. Fine metallic particles-containing fibers as claimed in claim 1, which have a degree of deodorization for any of hydrogen sulfide and ammonia, as measured according to the following deodorization test and represented by the following equation, of 60% or more:

Deodorization Test: Two grams of a sample to be tested is put in a bag made of polyvinyl flouride film along with one liter of air containing 30 ppm of an odor component, hydrogen sulfide or ammonia, then the bag is sealed, and, after 2 hours, the concentration of the odor component in the bag is measured using a detecting tube;

Degree of Deodorization (%) =[(initial concentration−concentration after 2 hours)/(initial concentration)]× 100.

6. A method for producing fine metallic particles-containing fibers, comprising applying metal ions to crosslinked fibers having ion-exchangeable or ion-coordinable polar groups to thereby make the substantially insoluble metal ions ion-exchanged or ion-coordinated with the polar groups, followed by immediately reducing the fibers to thereby make fine metal particles precipitated in the crosslinked fibers.

7. The method for producing fine metallic particles-containing fibers as claimed in claim 6, wherein the fine metal particles are those of one or more selected from Ti, V, Cr, Fe, Mn, Co, Ni, Cu, Zn, Ga, Ge, Se, Zr, Nb, Mo, Ru, Rh, Pd, Ag, Cd, In, Sn, Sb, Te, Hf, Ta, W, Re, Os, Ir, Pt, Au, Hg, Tl, Pb and Bi.

8. The method for producing fine metallic particles-containing fibers as claimed in claim 6, wherein the fibers with crosslinked structure are porous fibers having pores with pore sizes of 1.0 $\mu$m or smaller and wherein the pores are connected with one another and have openings on the surfaces of the fibers.

9. The method for producing fine metallic particles-containing fibers as claimed in claim 6, wherein the fibers with crosslinked structure are of a crosslinked acrylonitrile polymer as crosslinked with hydrazine and wherein 0.1% by weight or more of the nitrile groups remaining in the polymer have been converted into carboxyl groups.

10. A method for producing fine metallic particles-containing fibers, comprising applying metal ions or ions bonding to metal ions to precipitate substantially insoluble metallic salts to crosslinked fibers having ion-exchangeable or ion-coordinable polar groups to thereby make the ions ion-exchanged or ion-coordinated with the polar groups, then adding a compound capable of precipitating a substantially insoluble metallic salt to the fibers to thereby make fine particles of a substantially insoluble metallic salt precipitated in the crosslinked fibers.

11. A method for producing fine metallic particles-containing fibers, comprising applying metal ions or ions bonding to metal ions to precipitate substantially insoluble metallic salts to crosslinked fibers having ion-exchangeable or ion-coordinable polar groups to thereby make the ions ion-exchanged or ion-coordinated with the polar groups, then adding a compound capable of precipitating a substantially insoluble metallic salt to the fibers to thereby make fine particles of a substantially insoluble metallic salt precipitated in the crosslinked fibers, and thereafter reducing them to thereby make fine particles of a substantially insoluble metal and a substantially insoluble metallic salt precipitated in the crosslinked fibers.

12. The method for producing fine metallic particles-containing fibers as claimed in claim 10, wherein the fine particles of a metal and/or a substantially insoluble metallic salt are those of one or more metals selected from the group consisting of Cu, Fe, Ni, Zn, Ag, Ti, Co, Al, Cr, Pb, Sn, In, Zr, Mo, Mn, Cd, Bi and Mg, and/or one or more substantially insoluble metallic salts thereof selected from the group consisting of oxides, hydroxides, chlorides, bromides, iodides, carbonates, phosphates, chlorates, bromates, iodates, sulfates, sulfites, thiosulfates, thiocyanates, pyrophosphates, polyphosphates, silicates, aluminates, tungstates, vanadates, molybdates, antimonates, benzoates and dicarboxylates of such metals.

13. The method for producing fine metallic particles-containing fibers as claimed in claim 10, wherein the crosslinked fibers are porous fibers having pores with pore sizes of 1.0 $\mu$m or smaller and wherein the pores are connected with one another and have openings on the surfaces of the fibers.

14. The method for producing fine metallic particles-containing fibers as claimed in claim 10, wherein the fibers that contain fine particles of a metal and/or a substantially insoluble metallic salt are of a crosslinked acrylonitrile polymer as crosslinked with hydrazine and wherein 0.1% by weight or more of the nitrile groups remaining in the polymer have been converted into carboxyl groups.

15. The method for producing fine metallic particles-containing fibers as claimed in claim 11, wherein the fine particles of a metal and/or a substantially insoluble metallic salt are those of one or more metals selected from the group consisting of Cu, Fe, Ni, Zn, Ag, Ti, Co, Al, Cr, Pb, Sn, In, Zr, Mo, Mn, Cd, Bi and Mg, and/or one or more substantially insoluble metallic salts thereof selected from the group consisting of oxides, hydroxides, chlorides, bromides, iodides, carbonates, phosphates, chlorates, bromates, iodates, sulfates, sulfites, thiosulfates, thiocyanates, pyrophosphates, polyphosphates, silicates, aluminates, tungstates, vanadates, molybdates, antimonates, benzoates and dicarboxylates of such metals.

16. The method for producing fine metallic particles-containing fibers as claimed in claim 11, wherein the crosslinked fibers are porous fibers having pores with pore sizes of 1.0 $\mu$m or smaller and wherein the pores are connected with one another and have openings on the surfaces of the fibers.

17. The method for producing fine metallic particles-containing fibers as claimed in claim 11, wherein the fibers that contain fine particles of a metal and/or a substantially insoluble metallic salt are of a crosslinked acrylonitrile polymer as crosslinked with hydrazine and wherein 0.1% by weight or more of the nitrile groups remaining in the polymer have been converted into carboxyl groups.

18. The product of the process of claim 6.

19. The product of the process of claim 10.

20. The product of the process of claim 11.

* * * * *